US006059317A

United States Patent [19]

Wiley

[11] Patent Number: 6,059,317

[45] Date of Patent: May 9, 2000

[54] STAMP DISPLAY SYSTEM

[76] Inventor: Bennie Wiley, 1844 Flores St., Seaside, Calif. 93955

[21] Appl. No.: 09/070,565

[22] Filed: Apr. 30, 1998

[51] Int. Cl.[7] ..... B65D 85/30

[52] U.S. Cl. ..... 281/38; 402/79; 283/71; 206/455

[58] Field of Search ..... 281/38; 402/79; 283/71; 206/455

[56] References Cited

U.S. PATENT DOCUMENTS 4,972,952 11/1990 Reiseneder ..... 281/38
5,251,936 10/1993 Fitzibbons ..... 281/38
5,480,192 1/1996 Angerbauer et al. ..... 281/38
5,795,089 8/1998 Ong ..... 281/38
5,823,573 10/1998 Chang ..... 281/38

*Primary Examiner*—Willmon Fridie, Jr.
*Assistant Examiner*—Mark T. Henderson

[57] ABSTRACT

A stamp collection sleeve is provided including a pair of sheets of clear plastic integrally coupled along inboard edges, outboard edges, and top and bottom edges thereof. The sheets are each further coupled along lines for defining a plurality of compartments which are accessible via openings situated along a single line which extends between the compartments.

8 Claims, 2 Drawing Sheets

STAMP DISPLAY SYSTEM

BACKGROUND OF THE INVENTION

1. Field of the Invention

The present invention relates to photo albums and more particularly pertains to a new stamp display system for housing a plurality of first day cover issues provided by the postal service.

2. Description of the Prior Art

The use of photo albums is known in the prior art. More specifically, photo albums heretofore devised and utilized are known to consist basically of familiar, expected and obvious structural configurations, notwithstanding the myriad of designs encompassed by the crowded prior art which have been developed for the fulfillment of countless objectives and requirements.

Known prior art photo albums include U.S. Pat. No. 5,301,445; U.S. Pat. No. 5,119,574; U.S. Pat. No. Des. 277,490; U.S. Pat. No. 5,377,733; U.S. Pat. No. 5,375,936; and U.S. Pat. No. 5,316,404.

In these respects, the stamp display system according to the present invention substantially departs from the conventional concepts and designs of the prior art, and in so doing provides an apparatus primarily developed for the purpose of housing a plurality of first day cover issues provided by the postal service.

SUMMARY OF THE INVENTION

In view of the foregoing disadvantages inherent in the known types of photo albums now present in the prior art, the present invention provides a new stamp display system construction wherein the same can be utilized for housing a plurality of first day cover issues provided by the postal service.

The general purpose of the present invention, which will be described subsequently in greater detail, is to provide a new stamp display system apparatus and method which has many of the advantages of the photo albums mentioned heretofore and many novel features that result in a new stamp display system which is not anticipated, rendered obvious, suggested, or even implied by any of the prior art photo albums, either alone or in any combination thereof.

To attain this, the present invention generally comprises a pair of sheets of clear plastic integrally coupled along their inboard edges, outboard edges, and top and bottom edges. The sheets are each coupled along lines for defining a plurality of compartments which are accessible along a single line which extends between the compartments. Each of the compartments are preferably uniquely sized for housing first day cover issues of various sizes and shapes. The inboard edges of the sheets have a plurality of linearly aligned apertures formed therein for being coupled within a binder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stamp display system apparatus and method which has many of the advantages of the photo albums mentioned heretofore and many novel features that result in a new stamp display system which is not anticipated, rendered obvious, suggested, or even implied by any of the prior art photo albums, either alone or in any combination thereof.

It is another object of the present invention to provide a new stamp display system which may be easily and efficiently manufactured and marketed.

It is a further object of the present invention to provide a new stamp display system which is of a durable and reliable construction.

An even further object of the present invention is to provide a new stamp display system which is susceptible of a low cost of manufacture with regard to both materials and labor, and which accordingly is then susceptible of low prices of sale to the consuming public, thereby making such stamp display system economically available to the buying public.

Still yet another object of the present invention is to provide a new stamp display system which provides in the apparatuses and methods of the prior art some of the advantages thereof, while simultaneously overcoming some of the disadvantages normally associated therewith.

Still another object of the present invention is to provide a new stamp display system for housing a plurality of first day cover issues provided by the postal service.

Even still another object of the present invention is to provide a new stamp display system that includes a pair of sheets of clear plastic integrally coupled along inboard edges, outboard edges, and top and bottom edges thereof. The sheets are each further coupled along lines for defining a plurality of compartments which are accessible via openings situated along a single line which extends between the compartments.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
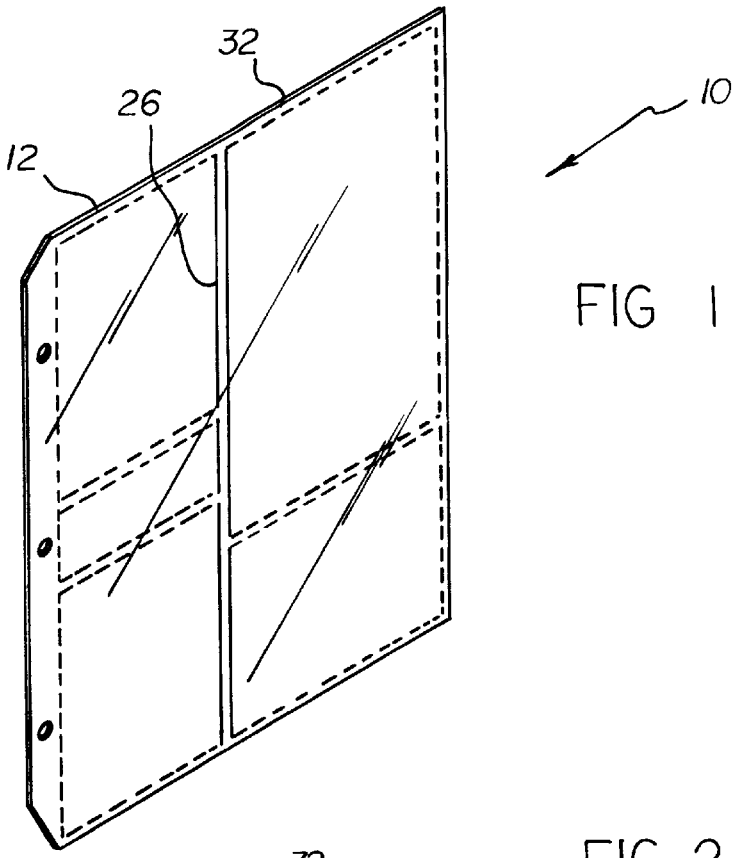
FIG. 1 is a perspective view of a new stamp display system according to the present invention.

With reference now to the drawings, and in particular to FIGS. 1 through 4 thereof, a new stamp display system embodying the principles and concepts of the present invention and generally designated by the reference numeral 10 will be described.

Figure 2:
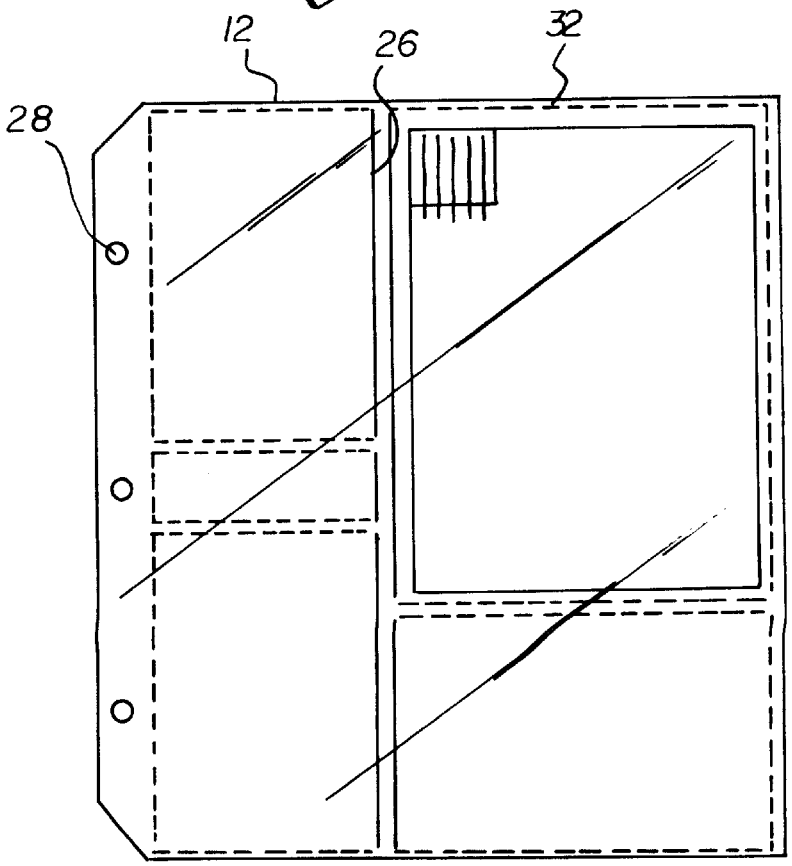
FIG. 2 is a front view of the present invention.

The present invention, designated as numeral 10, may take different forms of various complexity and configurations. FIGS. 1 & 2 show a simple unitary design while FIGS. 3 & 4 show a more elaborate versatile design.

Figure 3:
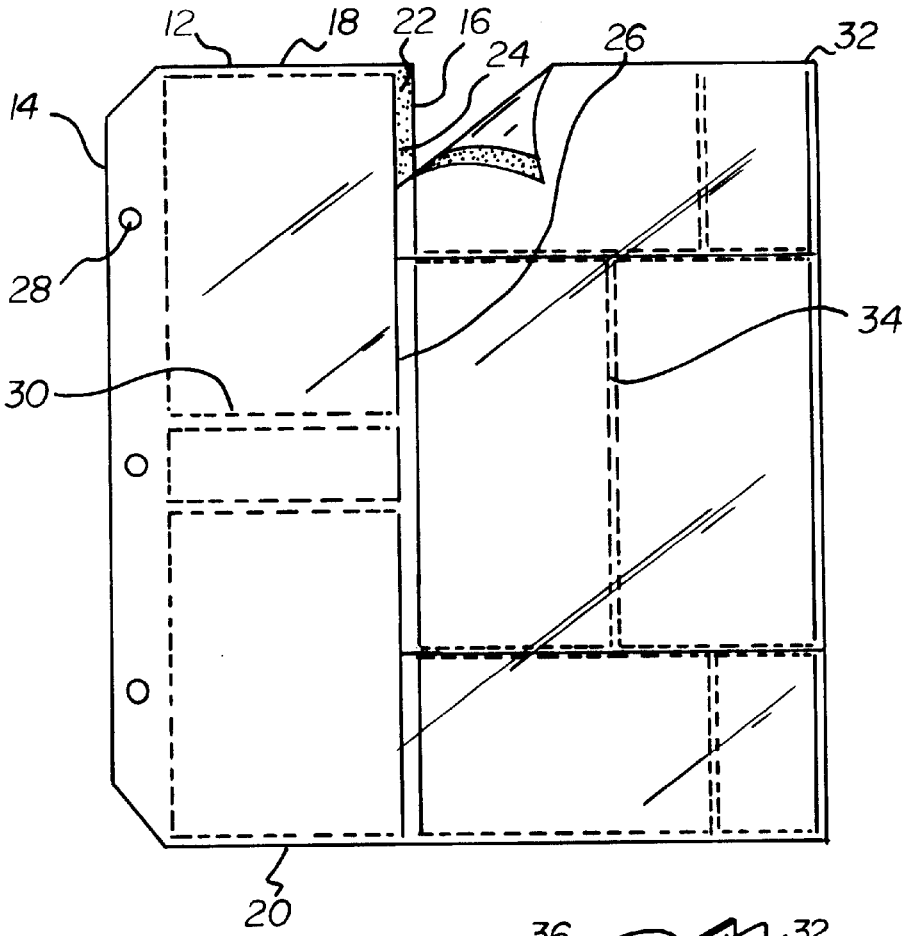
FIG. 3 is a front view of another embodiment of the present invention.
Figure 4:
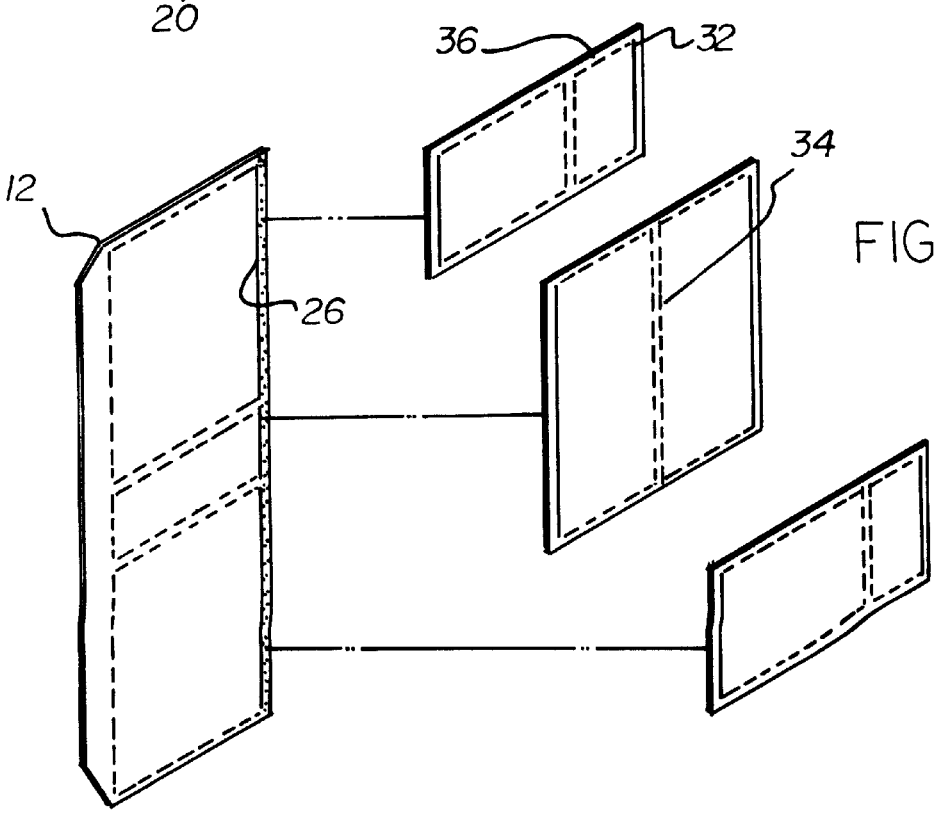
FIG. 4 is an exploded of the embodiment of the present invention shown in FIG. 3.

The embodiment of FIGS. 3 & 4 includes an inboard portion 12 having a pair of planar, rectangular sheets of clear plastic. Each sheet of the inboard portion is equipped with a periphery defined by an elongated inboard edge 14, an elongated outboard edge 16, a short top edge 18, and a short bottom edge 20. The sheets of the inboard portion are integrally coupled along the inboard edges thereof. As shown in FIGS. 3 & 4, a lower one of the sheets has an outboard edge which extends past that of an upper one of the sheets, thereby defining an extension 22. For reasons that will soon become apparent, a fastener 24 is situated on a top surface of the extension. Such fastener may take the form of a pile fastener, adhesive or the like.

The top edges and the bottom edges of the sheets of the inboard portion are further integrally coupled to define an opening 26 along the outboard edge of the sheets. For coupling within a three ring binder, the inboard edge of each of the sheets of the inboard portion has three linearly aligned apertures 28 formed therein. Ideally, the sheets of the inboard portion are coupled along lateral lines 30 extending between the inboard and outboard edges of the sheets for defining a large upper compartment and lower compartment with a small intermediate compartment situated therebetween. Each of the compartments of the inboard portion are equipped with an opening formed along the outboard edges of the sheets.

Next provided is a plurality of interchangeable, removable outboard portions 32 each including a common width. Further, each of the outboard portions has a length which is a fraction of that of the inboard portion. As shown in FIGS. 3 & 4, each outboard portion includes a pair of planar, rectangular sheets of clear plastic each with a periphery defined by an inboard edge, an outboard edge, a top edge, and a bottom edge.

The sheets of the outboard portions are each integrally coupled along the outboard edges thereof. As shown in FIG. 3, a lower one of the sheets of the outboard portions has an inboard edge which extends past that of an upper one of the sheets to define another extension. A fastener similar to that of the inboard portion is situated on a bottom surface of the inboard edge of each outboard portion. The top edges and the bottom edges of the sheets of each outboard portion are integrally coupled to define an opening along the inboard edge of the sheets of each of the outboard portions.

At least one of the sheets of the outboard portions is coupled along a longitudinal line 34 extending between the top and bottom edges of the sheets for defining an inboard compartment that is accessible via the opening. Also defined is an outboard compartment which is accessible via a slit 36 formed along the top edge thereof. As show in FIG. 4, a central outboard portion preferably has a first length and compartments of equal size. Further, a top and bottom outboard portion are included each with a second length less than the first length and an inboard compartment which is larger than an outboard portion. In use, the inboard and outboard portions define a 8½ by 11 sheet when coupled by way of the fasteners.

In the embodiment of FIGS. 1 & 2, the inboard and outboard portions are inseparable. It should be noted that various other embodiments may be constructed employing the principles of the present invention to afford different compartment configurations. In use, the compartments of the present invention are each adapted for housing a plurality of first day cover issues provided by the postal service. Basically, each of such first day cover issues comprises an envelope of a unique size and shape with a new stamp situated thereon.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described and accordingly, all suitable modifications and equivalents may be resorted to, falling within the scope of the invention.

I claim:

1. A stamp collection sleeve comprising, in combination:

an inboard portion including a pair of planar, rectangular sheets of clear plastic each with a periphery defined by an elongated inboard edge, an elongated outboard edge, a short top edge, and a short bottom edge, the sheets of the inboard portion being integrally coupled along the inboard edges thereof wherein a lower one of the sheets has an outboard edge which extends past that of an upper one of the sheets and has a fastener situated on a top surface thereof, the top edges and the bottom edges of the sheets of the inboard portion being inte grally coupled to define an opening along the outboard edge of the sheets of inboard portion, the inboard edge of each of the sheets having three linearly aligned apertures formed therein for coupling within a three ring binder, wherein the sheets of the inboard portion are coupled along lateral lines extending between the inboard and outboard edges of the sheets for defining a large upper compartment and lower compartment and a small intermediate compartment each with an opening formed along the outboard edges of the sheets; and a plurality of interchangeable, removable outboard portions each including a common width and a length which is a fraction of that of the inboard portion, each outboard portion including a pair of planar, rectangular sheets of clear plastic each with a periphery defined by an inboard edge, an outboard edge, a top edge, and a bottom edge, the sheets of the outboard portions each being integrally coupled along the outboard edges thereof wherein a lower one of the sheets of the outboard portions has an inboard edge which extends past that of an upper one of the sheets and has a fastener situated on a bottom surface thereof, the top edge and the bottom edges of the sheets of each outboard portion being integrally coupled to define an opening along the inboard edge of the sheets of each of the outboard portions, wherein at least one of the sheets of the outboard portions is coupled along a longitudinal line extending between the top and bottom edges of the sheets for defining an inboard compartment which is accessible via the opening and an outboard compartment which is accessible via a slit formed along the top edge thereof, wherein the inboard and outboard portions define a 8½ by 11 sheet when coupled by way of the fasteners.

2. A stamp collection sleeve comprising:

a pair of sheets of clear plastic integrally coupled along inboard edges, outboard edges, and top and bottom edges thereof, the sheets each coupled along an intermediate extent thereof for defining a plurality of compartments which are each accessible via openings situated along a single line which extends between the compartments, each of the compartments being sized for housing first day cover issues of various sizes and shapes, wherein the inboard edges of the sheets have a plurality of linearly aligned apertures formed therein for being coupled within a binder.

3. A stamp collection sleeve as set forth in claim 2 wherein the sheets are defined by an inboard portion and at least one outboard portion.

4. A stamp collection sleeve as set forth in claim 3 wherein the portions are separable and releasably coupled via a fastener.

5. A stamp collection sleeve as set forth in claim 4 wherein the fastener extends along the line.

6. A stamp collection sleeve as set forth in claim 4 wherein a plurality of outboard portions are include which together define a width equal to that of the inboard portion.

7. A stamp collection sleeve as set forth in claim 3 wherein the sheets of the outboard portion are coupled along at least one longitudinally extending line for defining an inboard compartment and an outboard compartment.

8. A stamp collection sleeve as set forth in claim 3 wherein the sheets of the outboard portion are coupled along at least one laterally extending line for defining a plurality of compartments.

* * * * *